US005815878A

United States Patent [19]

Murakami et al.

[11] Patent Number: 5,815,878

[45] Date of Patent: Oct. 6, 1998

[54] SWEEPER DEVICE

[75] Inventors: Masaki Murakami, Ehime-ken; Hiroki Ishikawa; Yasuhiko Kenmochi, both of Kagawa-ken, all of Japan

[73] Assignee: Uni-Charm Corporation, Ehime-ken, Japan

[21] Appl. No.: 772,633

[22] Filed: Dec. 23, 1996

[30] Foreign Application Priority Data

Jan. 9, 1996 [JP] Japan ..... 8-001822

[51] Int. Cl.[6] ..... A47L 13/44

[52] U.S. Cl. ..... 15/231; 15/228; 15/150

[58] Field of Search ..... 15/114, 115, 118, 15/147.1, 228, 231, 232, 233, 247, 150

[56] References Cited

U.S. PATENT DOCUMENTS

| | | | |
|---|---|---|---|
| 2,601,689 | 7/1952 | Mallard | 15/231 |
| 4,225,998 | 10/1980 | Thielen | 15/231 |
| 4,991,250 | 2/1991 | Young | 15/231 |

FOREIGN PATENT DOCUMENTS

| | | | |
|---|---|---|---|
| 3505973 | 8/1986 | Germany | 15/231 |
| 5-245091 | 9/1993 | Japan . | |
| WO 91/16849 | 11/1991 | WIPO | 15/147.1 |

*Primary Examiner*—Terrence Till
*Attorney, Agent, or Firm*—Lowe Hauptman Gopstein Gilman & Berner

[57] ABSTRACT

A sweeper device including a head, a stick mounted on an upper surface of the head and a sweeping sheet detachably attached to the head, a pair of clamping members being provided in a transversely symmetric relationship with respective inner ends thereof being opposed to each other, each of the clamping members being pivotally mounted at an inner end thereof on the upper surface of the head so that the clamping member can be pivotally opened upward from the upper surface of the head.

7 Claims, 4 Drawing Sheets

SWEEPER DEVICE

BACKGROUND OF THE INVENTION

The present invention relates to a sweeper device and, more particularly, to a sweeper device such as a broom adapted to be detachably equipped with a sweeping sheet and used to sweep a house floor or the like.

The sweeper device of such type is known, for example, from Japanese Laid-Open Patent Application No. Hei5-245091. This sweeper device comprises a transversely rectangular head and a stick mounted on an upper surface of the head, and a sweeping sheet is attached to the head by putting the sweeping sheet against a lower surface of the head, then folding marginal portions of the sweeping sheet along transversely long sides of the head back onto the upper surface of the head and finally clamping the marginal portions by clamping members provided on the upper surface of the head.

However, the known sweeper device is accompanied with a problem due to an arrangement thereof such that the clamping members are pivotally mounted on the upper surface of the head by a hinge mechanism. This hinge mechanism longitudinally extends parallel to the transversely long sides, between transversely opposite short sides by the head. Accordingly, this hinge mechanism obstructs the operation of folding when it is desired to fold the sweeping sheet along the short sides back onto the upper surface of the plate-like body and consequently makes it impossible to attach the sweeping sheet to the plate-like body.

SUMMARY OF THE INVENTION

In view of the problem as described above, it is a principal object of the invention to provide an improved sweeper device allowing a sweeping sheet to be tightly attached to a generally rectangular head defined by two pairs of parallel sides by folding the sweeping sheet back onto an upper surface of the head either along one pair of parallel sides or along the other pair of parallel sides.

The object set forth above is achieved, according to the invention, by a sweeping device comprising a rectangular plate-like head defined by two pairs of parallel sides, a stick mounted on an upper side of the head and a sweeping sheet detachably attached to the head to cover a bottom side of the head, wherein: means for detachably attaching the sweeping sheet to the head comprise a pair of clamping members provided at transversely symmetric positions on the upper surface of the head and having respective inner ends opposed to each other on a line substantially bisecting one of the two pairs of parallel sides and locking means formed in the upper surface of the head adapted to be releasably engaged with the clamping members, respectively; and the pair of clamping members are pivotally mounted at the inner ends thereof on the upper surface of the head so that a marginal portion of the sweeping sheet can be inserted between the clamping members and the upper surface of the head after the clamping members have been pivotally opened upward from the upper surface of the head and the clamping members can be brought into engagement with the locking means to hold the inserted marginal portion of the sweeping sheet between the clamping members and the upper surface of the head as the clamping members are closed.

DESCRIPTION OF THE PREFERRED EMBODIMENT

Figure 1:
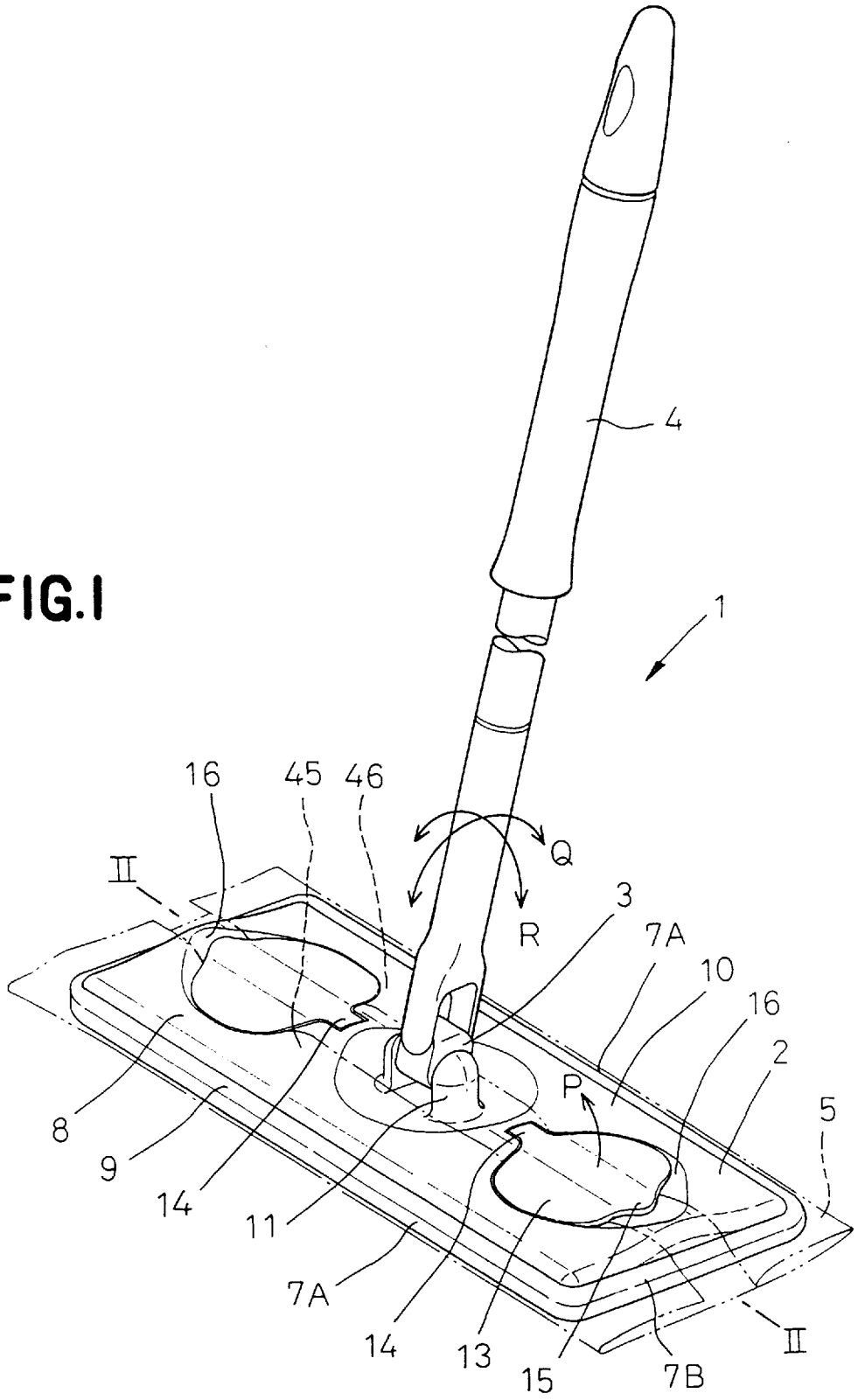
FIG. 1 is a perspective view showing a sweeper device according to the invention.

A sweeper device 1 shown by FIG. 1 in a perspective view comprises a plate-like head 2 and a stick 4 connected by a universal joint 3 of well known art to the head 2, and a sweeping sheet 5 is attached to the head as shown by imaginary lines. The sweeping sheet 5 is made of nonwoven fabric or the like.

The head 2 is configured in a rectangle defined by a pair of long sides 7A extending transversely with respect to the course of sweeping operation and a pair of short sides 7B connecting the long sides. The head 2 comprises a main body 8 made of hard plastic material and an elastic plate member 9 made of soft elastic material such as plastic and rubber covering a peripheral wall 21 (FIG. 2) of the main body 8. An upper surface 10 of the main body 8 is centrally provided on a line bisecting the pair of short sides 7B with a pair of transversely adjacent projections 11 for mounting of the universal joint 3 and provided between the respective short sides 7B and the respective projections 11 with recesses 16. Referring to FIG. 1, the respective recesses 16 have substantially entire areas thereof covered or mated with respective sheet clamping members 13 which are pivotable around inner ends 14 of the clamping members 13 relative to the main body 8. The clamping members 13 may be opened or closed relative to the associated recesses 16, with outer ends 15 thereof located aside toward the respective short sides 7B being held. After these clamping members 13 have been opened in the direction as indicated by an arrow P, a marginal portion of the sweeping sheet 5 may be folded onto the upper surface 10 of the main body 8 followed by closing the clamping members 13 to hold the sweeping sheet 5 between the upper surface 10 and the respective members 13 in an unremoved state of the sweeping sheet 5.

The stick 4 is made of hard plastic material and pivotable in two directions as indicated by double-headed arrows Q and R.

Figure 2:
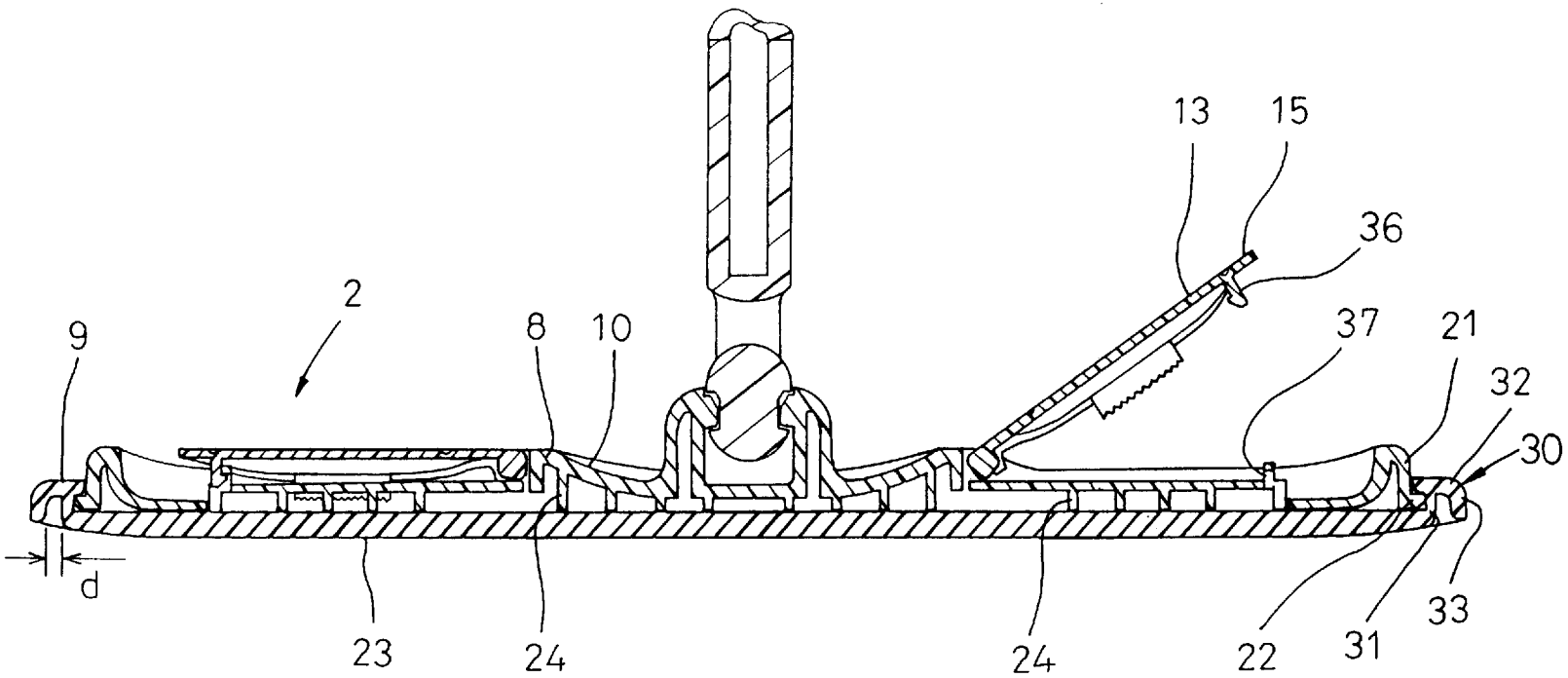
FIG. 2 is a sectional view taken along line II—II in FIG. 1.

FIG. 2 is a sectional view taken along line II—II in FIG. 1 and shows one of the clamping members 13 as being in opened state. In the head 2, the elastic plate member 9 has an inner peripheral side wall 31 tightly engaged with a flange 22 formed along a peripheral wall 21 of the main body 8 so that the peripheral wall 21 and the inner peripheral side wall 31 are substantially integral with each other. The elastic plate member 9 completely covers a lower side of the main body 8 and thereby forms a lower surface 23 of the head 2. A plurality of ribs 24 project downward from the lower side of the main body 8 and bear against an inner surface of the elastic plate member 9 from above. The elastic plate member 9 includes, in addition to the inner peripheral side wall 31, an outer peripheral side wall 30 having a generally inverted L-shaped cross-section extending outside the inner peripheral side wall 31. The side wall 30 comprises an inner section 32 extending outward from an upper end of the side wall 31 and an outer section 33 extending outward from the inner section 32 and then extending downward so that the outer section 33 is spaced apart outward from the side wall 31 by a predetermined distance d.

Figure 3:
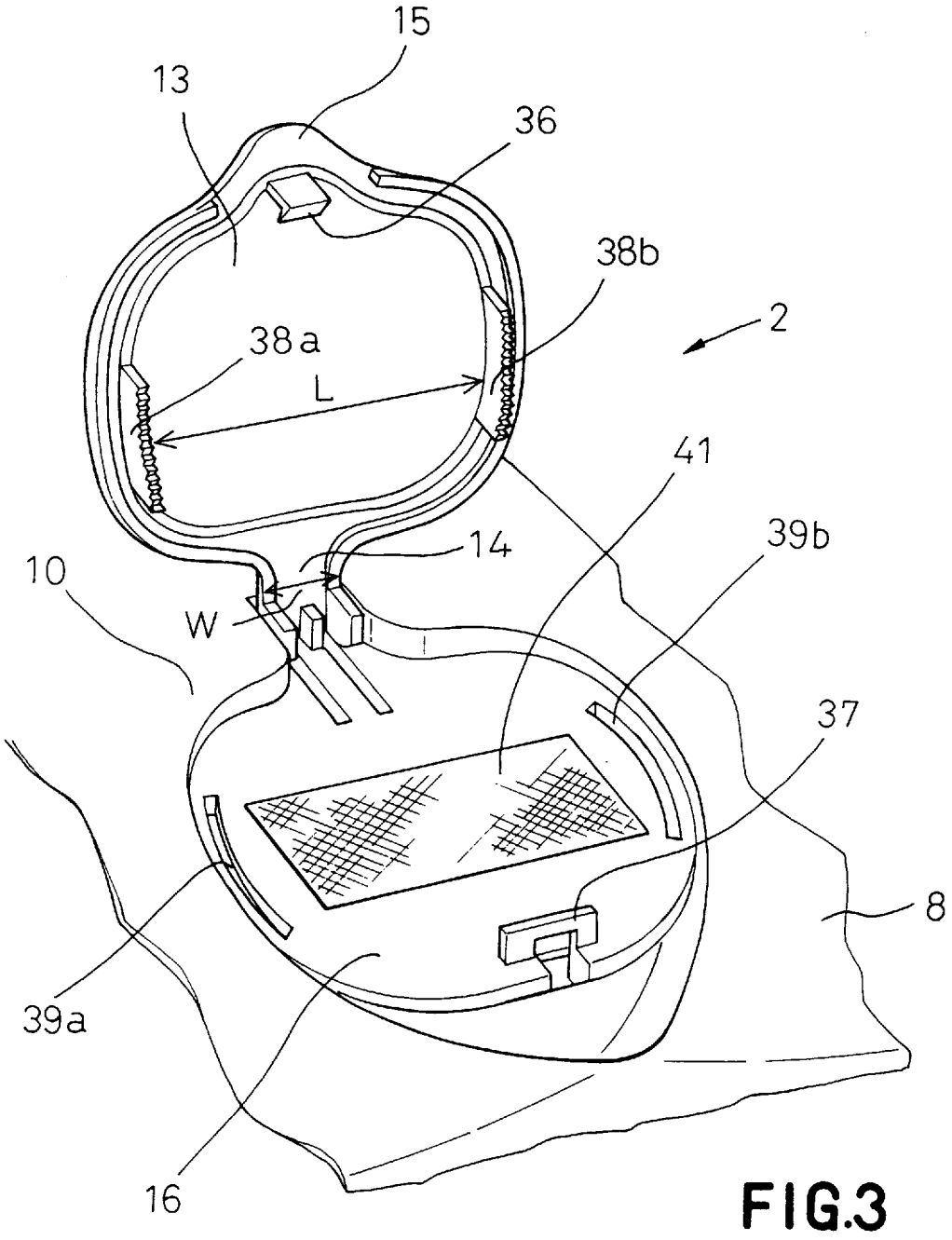
FIG. 3 is a fragmentary perspective view showing a head as a clamping member being in opened state.

FIG. 3 is a fragmentary perspective view showing the head 2, in which the clamping member 13 is in opened state.

The clamping member 13 is made of hard plastic material and includes a locking jaw 36 formed on a lower surface of the outer end 15. The locking jaw 36 is adapted to be engaged with a locking jaw 37 formed on the main body 8 in a latch fashion as the clamping member 13 is closed. The lower surface of the clamping member 13 is formed on transversely opposite sides thereof with a pair of locking projections 38*a*, 38*b* extending downward and having forward ends thereof in the form of sawteeth. These locking projections 38*a*, 38*b* are firmly inserted into a pair of slots 39*a*, 39*b* formed in the upper surface 10 of the ma in body 8 as the clamping member 13 is closed. A strip of hook tape 41 constituting one component of paired mechanical fastening tape known under the trade mark VELCRO is affixed to the main body 8 between the slots 39*a*, 39*b*.

Operation of the device 1 constructed as described above begins with opening the clamping members 13. Then, the sweeping sheet 5 is put over the lower surface 23 of the head 2 and transversely opposite marginal portions 45, 46 of the sweeping sheet 5 (FIG. 1) are folded onto the upper surface 10 of the head 2 so that the marginal portion 45 may cover the slots 39*a* and the marginal portion 46 may cover the slots 39*b*. These marginal portions 45, 46 are fastened to the hook tape 41. Then the clamping members 13 are closed to hold the sweeping sheet 5 between the side walls of the locking projections 38*a*, 38*b* and the side walls of the slots 39*a*, 39*b*. Simultaneously, the sweeping sheet 5 is engaged with the sawtoothed forward ends of the locking projections 38*a*, 38*b*. Such double fastening effect ensures that the sweeping sheet 5 is never removed from the head 2 during operation of cleaning the floor. Additionally, the presence of the elastic side wall 30 surrounding the head 2 is particularly effective in that the side wall 30 is elastically deformed and then tends to restore its initial position as the marginal portions 45, 46 are fastened to the hook tape 41 and the clamping members 13 are closed so as to tension the sweeping sheet 5. Restoration of the outer side wall 30 causes the sweeping sheet 5 to be further tensioned and thereby to be tightly held on the lower surface 23 of the head 2. To facilitate the clamping members 13 to hold the sheet, a distance L between the pair of locking means 37, 38 is dimensioned to be larger than a width W of the respective members, inner ends 14.

Figure 4:
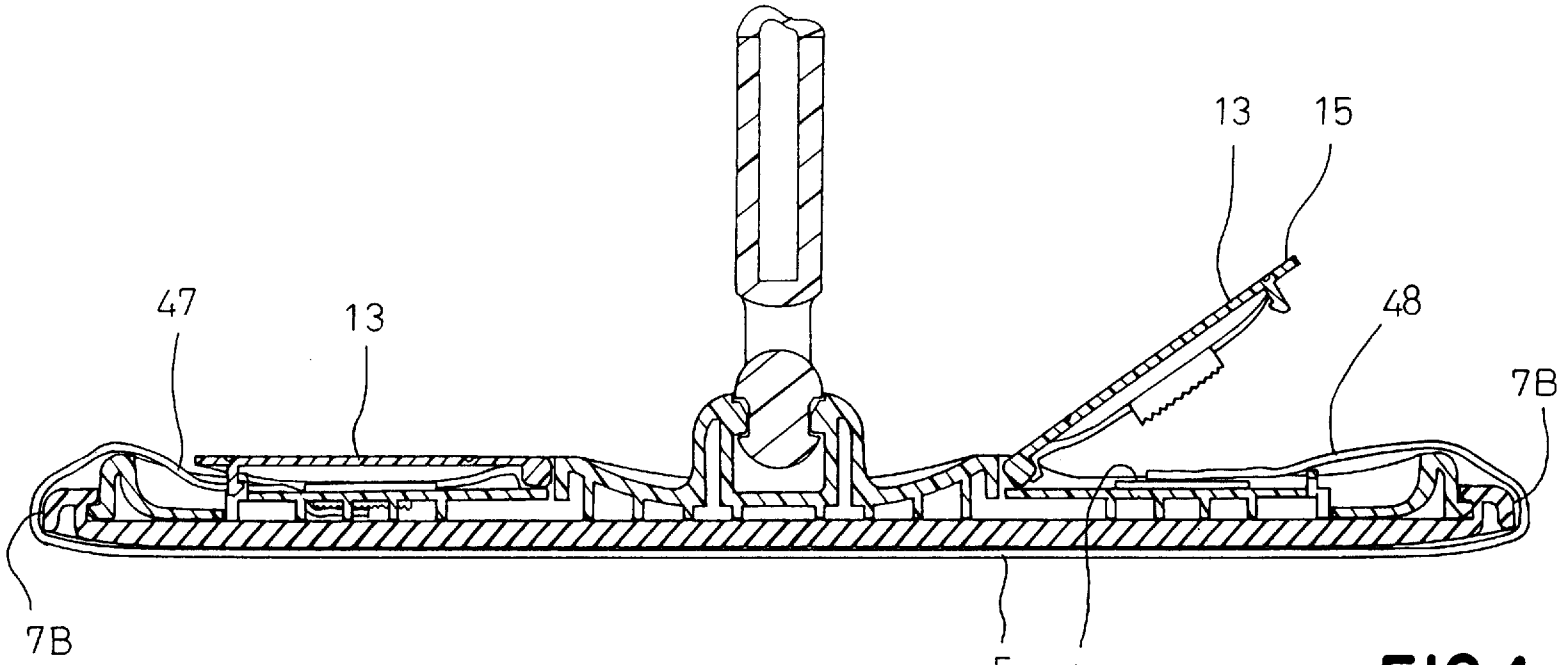
FIG. 4 is a view similar to FIG. 2, exemplarily showing a manner in which a sweeping sheet is clamped.

FIG. 4 shows the head 2 onto the upper surface of which the marginal portions 47, 48 of the sweeping sheet 5 have been folded along the short sides 7B and clamped by the clamping members 13. The sweeping sheet 5 which is relatively wide can be economically used by attaching it to the head 2 in t he manner as illustrated. It should be understood that the sweeping sheet 5 is disposed between the locking jaws 36 provided on the clamping members 13 and the locking jaws 37 provided on the main body 8.

With the sweeper device of the invention, two pairs of parallel sides 7A, 7B may be dimensioned so as to obtain a desired ratio between each long side 7A and each short side 7B.

The sweeper device according to the invention allows the sweeping sheets 5 of various sizes to be used because the sweeping sheet 5 can be folded back onto the upper surface of the head 2 either along the one pair of parallel sides 7A or along the other pair of sides 7B of the rectangular head 2 defined by these two pairs of parallel sides 7A, 7B.

What is claimed is:

1. A sweeper device comprising a generally rectangular head defined by two pairs of side walls, a stick mounted on an upper surface of the head and a sweeping sheet detachably attached to the head to cover a bottom side of the head, further comprising:

a pair of clamping members provided at transversely symmetric positions on the upper surface of the head and having respective inner ends opposed to each other and locking members formed in the upper surface of the head adapted to be releasably engaged with the clamping members, respectively; and wherein the pair of clamping members are pivotally mounted at the inner ends thereof on the upper surface of the head so that a marginal portion of the sweeping sheet can be inserted between the clamping members and the upper surface of the head after the clamping members have been pivotally opened upward from the upper surface of the head and the clamping members can be brought into engagement with the locking members to hold the inserted marginal portion of the sweeping sheet between the clamping members and the upper surface of the head as the clamping members are closed, wherein each of the clamping members comprises a locking jaw formed on a lower surface of an outer end opposed to the inner end of the clamping member and engaged with the locking members provided in the upper surface of the head.

2. A sweeper device according to claim 1, wherein the locking members provided in the upper surface of the head comprises a locking jaw formed on the surface of the head.

3. A sweeper device comprising a generally rectangular head defined by two pairs of side walls, a stick mounted on an upper surface of the head and a sweeping sheet detachably attached to the head to cover a bottom side of the head, further comprising:

a pair of clamping members provided at transversely symmetric positions on the upper surface of the head and having respective inner ends opposed to each other and locking members formed in the upper surface of the head adapted to be releasably engaged with the clamping members, respectively; and wherein the pair of clamping members are pivotally mounted at the inner ends thereof on the upper surface of the head so that a marginal portion of the sweeping sheet can be inserted between the clamping members and the upper surface of the head after the clamping members have been pivotally opened upward from the upper surface of the head and the clamping members can be brought into engagement with the locking members to hold the inserted marginal portion of the sweeping sheet between the clamping members and the upper surface of the head as the clamping members are closed, wherein the head is provided at transversely symmetric positions on the upper surface thereof with a pair of recesses which have substantially entire areas thereof covered with the respective clamping members.

4. A sweeper device according to claim 3, wherein each of the recesses comprises a pair of slots formed at opposite sides on an bottom thereof, and each of the clamping members comprises a pair of locking projections formed at opposite sides on the lower surface thereof to be inserted into the respective slots as the clamping members are mated with the recesses.

5. A sweeper device according to claim 4, wherein each of the locking projections has a forward end in the form of sawteeth.

6. A sweeper device according to claim 3, wherein each of the recesses comprises a hook tape affixed to the bottom thereof.

7. A sweeper device comprising a generally rectangular head defined by two pairs of side walls, a stick mounted on an upper surface of the head and a sweeping sheet detachably attached to the head to cover a bottom side of the head, further comprising:

a pair of clamping members provided at transversely symmetric positions on the upper surface of the head and having respective inner ends opposed to each other and locking members formed in the upper surface of the head adapted to be releasably engaged with the clamping members, respectively; and wherein the pair of clamping members are pivotally mounted at the inner ends thereof on the upper surface of the head so that a marginal portion of the sweeping sheet can be inserted between the clamping members and the upper surface of the head after the clamping members have been pivotally opened upward from the upper surface of the head and the clamping members can be brought into engagement with the locking members to hold the inserted marginal portion of the sweeping sheet between the clamping members and the upper surface of the head as the clamping members are closed, wherein the head comprises a main body made of hard plastic material and an elastic plate member made of soft elastic material covering a bottom and a peripheral edge of the main body.

* * * * *